US008985739B2

(12) United States Patent
Tanda

(10) Patent No.: US 8,985,739 B2
(45) **Date of Patent: *Mar. 24, 2015**

(54) CAP FOR CAPPING INK DISCHARGE OPENING OF NOZZLE HEAD IN INK-JET RECORDING APPARATUS

(71) Applicant: KYOCERA Document Solutions Inc., Osaka (JP)

(72) Inventor: Tetsuo Tanda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/165,212

(22) Filed: Jan. 27, 2014

(65) Prior Publication Data

US 2014/0210903 A1 Jul. 31, 2014

(30) Foreign Application Priority Data

Jan. 29, 2013 (JP) ..... 2013-014592

(51) Int. Cl.
*B41J 2/165* (2006.01)

(52) U.S. Cl.
CPC ..... *B41J 2/16505* (2013.01); *B41J 2/16511* (2013.01); *B41J 2/16588* (2013.01); *B41J 2002/16591* (2013.01)
USPC ..... 347/29

(58) Field of Classification Search
CPC .... B41J 2/155; B41J 2/16505; B41J 2/16508; B41J 2/16511; B41J 2/16526; B41J 2/16535; B41J 2/16547; B41J 2/16552; B41J 2/16585
USPC ..... 347/22, 29
See application file for complete search history.

(56) References Cited

U.S. PATENT DOCUMENTS

| | | | | |
|---|---|---|---|---|
| 2004/0113971 | A1* | 6/2004 | Nakajima | 347/29 |
| 2004/0246295 | A1* | 12/2004 | Aldrich et al. | 347/29 |
| 2004/0252157 | A1* | 12/2004 | Yamazaki et al. | 347/31 |
| 2005/0024422 | A1* | 2/2005 | Danzuka | 347/29 |
| 2005/0110827 | A1* | 5/2005 | Aldrich et al. | 347/29 |
| 2007/0070115 | A1* | 3/2007 | Shindo | 347/29 |
| 2009/0027444 | A1* | 1/2009 | Yoshida et al. | 347/29 |
| 2010/0045733 | A1* | 2/2010 | Mano | 347/29 |
| 2011/0018931 | A1* | 1/2011 | Ikeda | 347/29 |
| 2011/0199422 | A1* | 8/2011 | Shimazaki | 347/29 |
| 2014/0210904 | A1* | 7/2014 | Takahashi | 347/29 |

FOREIGN PATENT DOCUMENTS

JP 2002-331673 A 11/2002

* cited by examiner

*Primary Examiner* — Manish S Shah
*Assistant Examiner* — Roger W Pisha, II
(74) *Attorney, Agent, or Firm* — Stein IP, LLC

(57) ABSTRACT

A cap for capping an ink discharge opening of a nozzle head includes a cap main body and an atmosphere communication unit. The cap main body is configured to cap the ink discharge opening. The atmosphere communication unit is configured to couple an internal space of the cap main body to atmosphere in a state where the cap main body caps the ink discharge opening. The cap main body is configured to couple the internal space to the ink discharge opening in a state where the ink discharge opening is capped. The atmosphere communication unit includes a venthole integrally formed to the cap main body, and a tube coupled to the venthole so as to couple the internal space to atmosphere. The tube includes one end coupled to the venthole using press fitting.

11 Claims, 11 Drawing Sheets

300
310
310
350
340
326
326M
326C
326Y
326K
384
388
381
386
382
361
360
320
Z
Y
X

CAP FOR CAPPING INK DISCHARGE OPENING OF NOZZLE HEAD IN INK-JET RECORDING APPARATUS

CROSS-REFERENCE TO RELATED APPLICATION

This application is based upon, and claims the benefit of priority from, corresponding Japanese Patent Application No. 2013-014592 filed in the Japan Patent Office on Jan. 29, 2013, the entire contents of which are incorporated herein by reference.

BACKGROUND

Unless otherwise indicated herein, the description in this section is not prior art to the claims in this application and is not admitted to be prior art by inclusion in this section.

An ink-jet recording apparatus is widely used for a printer, a multi-functional peripheral, and a copier, for example, due to reasons such as its compactness, inexpensive price, and quietness of operating sound. The ink-jet recording apparatus discharges ink droplets from many nozzles provided to an inkjet head and forms an image on a recording-target medium such as paper.

If ink is vaporized at an ink discharge opening at a distal end of the nozzle, density of ink increases. This may result in clogging of the ink discharge opening. Therefore, the ink-jet recording apparatus includes a cap that caps the ink discharge opening.

At the ink-jet recording apparatus, an interface of the ink is slightly depressed at the ink discharge opening by surface tension, forming a so-called meniscus. The meniscus is broken at considerably small pressure. If the meniscus is broken, a malfunction, such as unstable discharge of the ink, occurs at the ink-jet recording apparatus.

If the cap internal space is sealed with the ink discharge opening capped by the cap, the meniscus is possibly broken by pressure from the internal space. Thus, a structure having the internal space of the cap that communicates with the atmosphere has been proposed.

With this structure, one end of a metal pipe is communicatively coupled to a venthole formed at a cap main body via a cap base to allow the internal space of the cap to communicate with the atmosphere using the metal pipe.

SUMMARY

A cap according to a first aspect of the present disclosure is a cap for capping an ink discharge opening of a nozzle head includes a cap main body and an atmosphere communication unit. The cap main body is configured to cap the ink discharge opening. The atmosphere communication unit is configured to couple an internal space of the cap main body to the atmosphere in a state where the cap main body caps the ink discharge opening. The cap main body is configured to couple the internal space to the ink discharge opening in a state where the ink discharge opening is capped. The atmosphere communication unit includes a venthole integrally formed to the cap main body, and a tube coupled to the venthole so as to couple the internal space to the atmosphere. The tube includes one end coupled to the venthole using press fitting.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
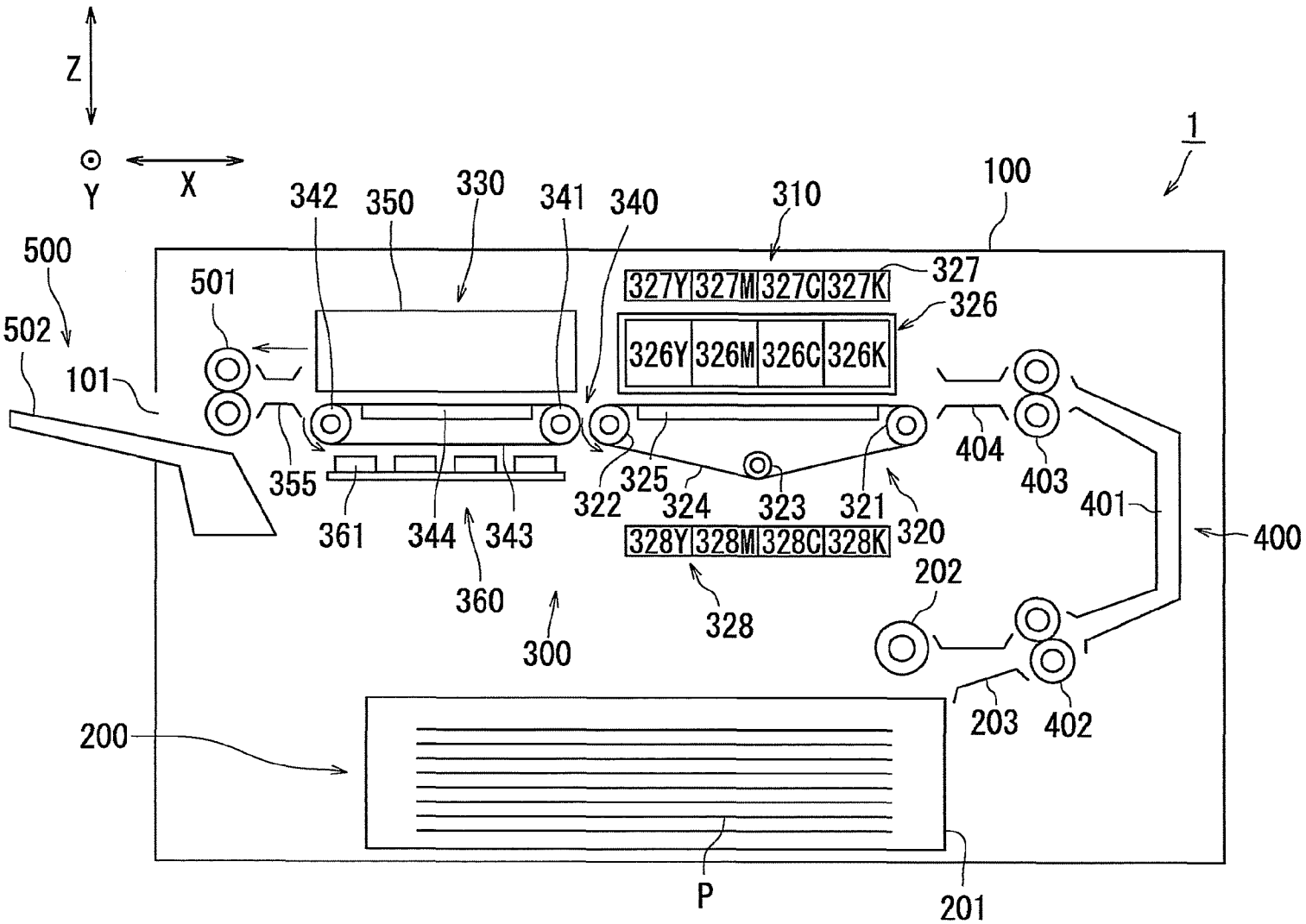
FIG. 1 is a schematic diagram illustrating a schematic configuration of an ink-jet recording apparatus according to an embodiment.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments according to this disclosure with reference to the drawings. FIG. 1 is a schematic diagram illustrating a schematic configuration of an ink-jet recording apparatus 1 according to an embodiment.

The ink-jet recording apparatus 1 includes an apparatus casing 100, a paper sheet feeder 200, an image forming unit 300, a paper sheet conveyor 400, and a paper discharge unit 500. The paper sheet feeder 200 is disposed downward inside the apparatus casing 100. The image forming unit 300 is disposed above the paper sheet feeder 200. The paper sheet conveyor 400 is disposed on one side of the image forming unit 300 while the paper discharge unit 500 is disposed on the other side of the image forming unit 300.

The paper sheet feeder 200 includes a paper feed cassette 201 attachable/detachable to/from the apparatus casing 100, a paper feeding roller 202, and a guide plate 203. The paper feeding roller 202 is disposed upward of one end side of the paper feed cassette 201. The guide plate 203 is disposed between the paper feeding roller 202 and the paper sheet conveyor 400.

The paper feed cassette 201 internally houses many stacked paper sheets P. The paper feeding roller 202 takes out a paper sheet P in the paper feed cassette 201 one by one. The guide plate 203 guides the paper sheet P taken out by the paper feeding roller 202 to the paper sheet conveyor 400.

The paper sheet conveyor 400 includes an approximately C-shaped paper sheet conveyance passage 401, a conveyance roller pair 402, a registration roller pair 403, and a guide plate 404. The conveyance roller pair 402 is disposed on the entry side of the paper sheet conveyance passage 401 while the registration roller pair 403 is disposed on the exit side of the paper sheet conveyance passage 401. The guide plate 404 is disposed between the registration roller pair 403 and the image forming unit 300.

The conveyance roller pair 402 sandwiches the paper sheet P fed from the paper sheet feeder 200 and delivers the paper sheet P to the paper sheet conveyance passage 401. The registration roller pair 403 corrects a skew of the paper sheet P supplied from the paper sheet conveyance passage 401. The registration roller pair 403 keeps the paper sheet P temporarily waiting to synchronize the timing of printing with the conveyance of the paper sheet P, and then delivers the paper sheet P to the guide plate 404 in accordance with the printing timing. The guide plate 404 guides the paper sheet P delivered by the registration roller pair 403 to the image forming unit 300.

The image forming unit 300 includes a recording unit 310, a drying unit 330, a cap unit 360, and a driving mechanism (not shown).

The recording unit 310 includes a conveyance unit 320, a recording head 326, a pump unit 327, and a tank unit 328. The recording head 326 is disposed above the conveyance unit 320 while the tank unit 328 is disposed below the conveyance unit 320. The pump unit 327 is disposed above the recording head 326.

The conveyance unit 320 includes a supporting roller 321, a drive roller 322, a tension roller 323, an endless conveyance belt 324, and a suction unit 325. The conveyance belt 324 is tightly stretched between the supporting roller 321, the drive roller 322, and the tension roller 323. Many suction holes (not shown) are bored on the conveyance belt 324.

The drive roller 322 is spaced with respect to the supporting roller 321 in the paper sheet conveying direction. The drive roller 322 is rotatably driven by a motor (not shown) and rotates the conveyance belt 324 anticlockwise. The tension roller 323 is disposed downward between the supporting roller 321 and the drive roller 322 and adds tension to the conveyance belt 324 to prevent deflection of the conveyance belt 324.

The recording head 326 is constituted to include four nozzle heads 326K, 326C, 326M, and 326Y arranged side by side from upstream to downstream in the paper sheet conveying direction.

The pump unit 327 is constituted to include four ink supply pumps 327K, 327C, 327M, and 327Y arranged side by side from upstream to downstream in the paper sheet conveying direction.

The tank unit 328 is constituted to include four ink tanks 328K, 328C, 328M, and 328Y arranged side by side from upstream to downstream in the paper sheet conveying direction.

Each of the nozzle heads 326K, 326C, 326M, and 326Y includes many nozzles arranged in a width direction (Y direction) of the conveyance belt 324. The recording head 326 is referred to as a line type. The line type recording head 326 is, for example, secured to the apparatus casing 100.

Each of many nozzles of the nozzle head 326K communicates with the pressurization chamber (not shown) formed in the nozzle head 326K. The pressurization chamber communicates with the ink liquid chamber (not shown) formed in the nozzle head 326K. The ink liquid chamber is communicatively coupled to the ink supply pump 327K via the tube (not shown). The ink supply pump 327K is communicatively coupled to the ink tank 328K via the tube (not shown).

Each of many nozzles of the nozzle head 326C communicates with the pressurization chamber (not shown) formed in the nozzle head 326C. The pressurization chamber communicates with the ink liquid chamber (not shown) formed in the nozzle head 326C. The ink liquid chamber is communicatively coupled to the ink supply pump 327C via the tube (not shown). The ink supply pump 327C is communicatively coupled to the ink tank 328C via the tube (not shown).

Each of many nozzles of the nozzle head 326M communicates with the pressurization chamber (not shown) formed in the nozzle head 326M. The pressurization chamber communicates with the ink liquid chamber (not shown) formed in the nozzle head 326M. The ink liquid chamber is communicatively coupled to the ink supply pump 327M via the tube (not shown). The ink supply pump 327M is communicatively coupled to the ink tank 328M via the tube (not shown).

Each of many nozzles of the nozzle head 326Y communicates with the pressurization chamber (not shown) formed in the nozzle head 326Y. The pressurization chamber communicates with the ink liquid chamber (not shown) formed in the nozzle head 326Y. The ink liquid chamber is communicatively coupled to the ink supply pump 327Y via the tube (not shown). The ink supply pump 327Y is communicatively coupled to the ink tank 328Y via the tube (not shown).

The suction unit 325 is disposed on one surface side of the conveyance belt 324 so as to face the recording head 326 across the conveyance belt 324. The suction unit 325 internally includes a suction mechanism (not shown), such as a fan and a vacuum pump. Driving the suction mechanism generates negative pressure in the suction unit 325. The negative pressure acts on the paper sheet P placed on the other surface of the conveyance belt 324 through many suction holes on the conveyance belt 324 and then the paper sheet P is suctioned onto the conveyance belt 324.

A drying unit 330 includes a conveyance unit 340, a dryer 350, and a guide plate 355. The dryer 350 is disposed above the conveyance unit 340.

The conveyance unit 340 includes a supporting roller 341, a drive roller 342, an endless conveyance belt 343, and a suction unit 344. The conveyance belt 343 is tightly stretched between the supporting roller 341 and the drive roller 342. Many suction holes (not shown) are bored on the conveyance belt 343.

The drive roller 342 is spaced with respect to the supporting roller 341 in the paper sheet conveying direction. The drive roller 342 is rotatably driven by a motor (not shown) and rotates the conveyance belt 343 counter-clockwise.

The suction unit 344 is disposed on one surface side of the conveyance belt 343 so as to face the dryer 350 across the conveyance belt 343. The suction unit 344 internally includes a suction mechanism (not shown), such as a fan and a vacuum pump. Driving the suction mechanism generates negative pressure in the suction unit 344. The negative pressure acts on the paper sheet P placed on the other surface of the conveyance belt 343 through many suction holes on the conveyance belt 343 and then the paper sheet P is suctioned onto the conveyance belt 343.

The dryer 350 may blow hot air to the paper sheet P to dry ink droplets discharged from the recording head 326 onto the paper sheet P.

The guide plate 355 guides the paper sheet P delivered by the conveyance unit 340 to the paper discharge unit 500.

The cap unit 360 includes a plurality of caps 361. The plurality of caps 361 are disposed corresponding to the respective nozzle heads 326K, 326C, 326M, and 326Y. The cap unit 360 is supported by a support bracket (not shown). The support bracket is slidably guided to the X direction by a guide rail (not shown). The cap 361 will be described in detail later.

A driving mechanism (not shown) moves the cap unit 360 in the X direction by sliding the support bracket, which supports the cap unit 360, along the guide rail (not shown).

The paper discharge unit 500 includes a discharge roller pair 501 and a discharge tray 502. The discharge tray 502 is secured to the apparatus casing 100 so as to project outside from a discharge port 101 formed at the apparatus casing 100.

The paper sheet P that has passed the dryer 350 is delivered in the direction of the discharge port 101 by the discharge roller pair 501, guided by the discharge tray 502, and discharged outside of the apparatus casing 100 via the discharge port 101.

FIG. 2A to FIG. 2E are schematic views illustrating operations of the conveyance unit 320 and the cap unit 360 of the ink-jet recording apparatus 1 illustrated in FIG. 1.

The ink-jet recording apparatus 1 further includes an elevating mechanism 381. The elevating mechanism 381 moves up and down the conveyance unit 320 of the recording unit 310. The elevating mechanism 381 includes a guiding member (not shown), a wire 382, a roller 384, a motor 386, and a clutch 388.

The guiding member extends in the vertical direction and liftably guides the conveyance unit 320 in the Z direction.

One end of the wire 382 is installed to the conveyance unit 320 and the other end is installed to the roller 384. The wire 382 suspends and supports the conveyance unit 320.

The roller 384 is rotatably centering a rotation shaft (not shown) extending in the X direction. By rotation of the roller 384 in one direction, the wire 382 is rolled up by the roller 384, and by rotation of the roller 384 in the other direction, the wire 382 is wound off the roller 384.

A drive shaft (not shown) of the motor 386 is coupled to the rotation shaft of the roller 384 via the clutch 388. The motor 386 rotates the roller 384 in both directions.

The clutch 388 switches a state where the drive shaft for the motor 386 is coupled to the rotation shaft for the roller 384 and a state where the drive shaft for the motor 386 is detached from the rotation shaft for the roller 384.

Next, operations of the conveyance unit 320 and the cap unit 360 will be described based on FIG. 2A to FIG. 2E.

Figures 2A, 2B, 2C, 2D, 2E:
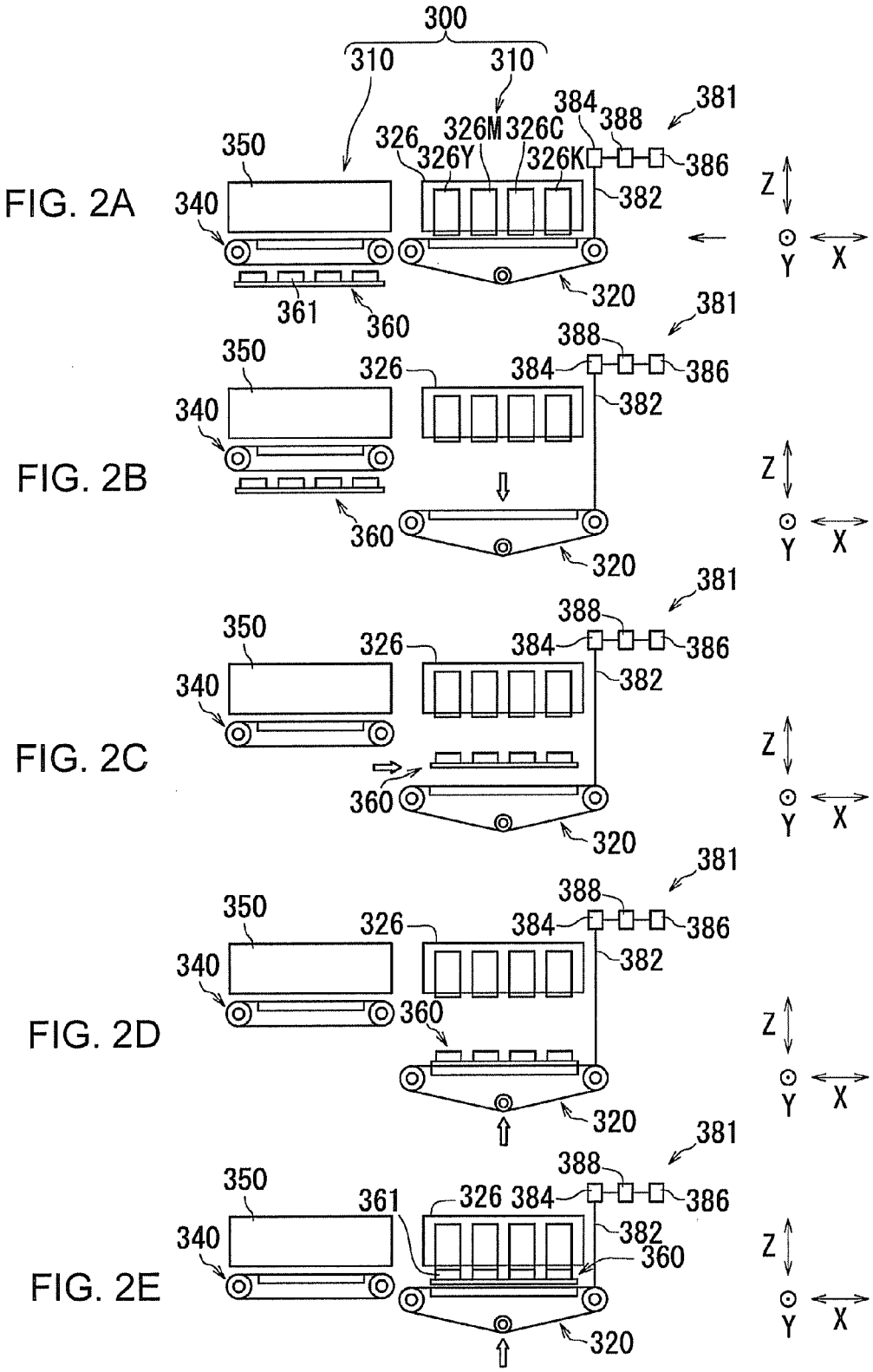
FIG. 2A to FIG. 2E are schematic views illustrating operations of a conveyance unit and a cap unit of the ink-jet recording apparatus illustrated in FIG. 1.

FIG. 2A illustrates a state where an image can be formed on a paper sheet. The nozzle heads 326K, 326C, 326M, and 326Y of the recording head 326 discharge ink on the paper sheet, and the dryer 350 dries the ink on the paper sheet, thus the image is formed on the paper sheet.

To cap the ink discharge opening of the recording head 326, as illustrated in FIG. 2B, the motor 386 of the elevating mechanism 381 is driven first, the wire 382 is wound off the roller 384, and the conveyance unit 320 moves down to a retracted position.

Next, as illustrated in FIG. 2C, the driving mechanism (not shown) horizontally moves the cap unit 360 and disposes the cap unit 360 immediately below the recording head 326.

Next, as illustrated in FIG. 2D, the motor 386 for the elevating mechanism 381 is driven, the wire 382 is rolled up by the roller 384, the conveyance unit 320 goes up, and the conveyance unit 320 contacts the cap unit 360.

Next, as illustrated in FIG. 2E, the motor 386 of the elevating mechanism 381 is driven, the wire 382 is rolled up by the roller 384, and the conveyance unit 320 and the cap unit 360 go up. Then, the four caps 361 of the cap unit 360 contact the nozzle heads 326K, 326C, 326M, and 326Y of the recording head 326. As a result, the ink discharge openings of the nozzle heads 326K, 326C, 326M, and 326Y are capped.

Figure 3A:
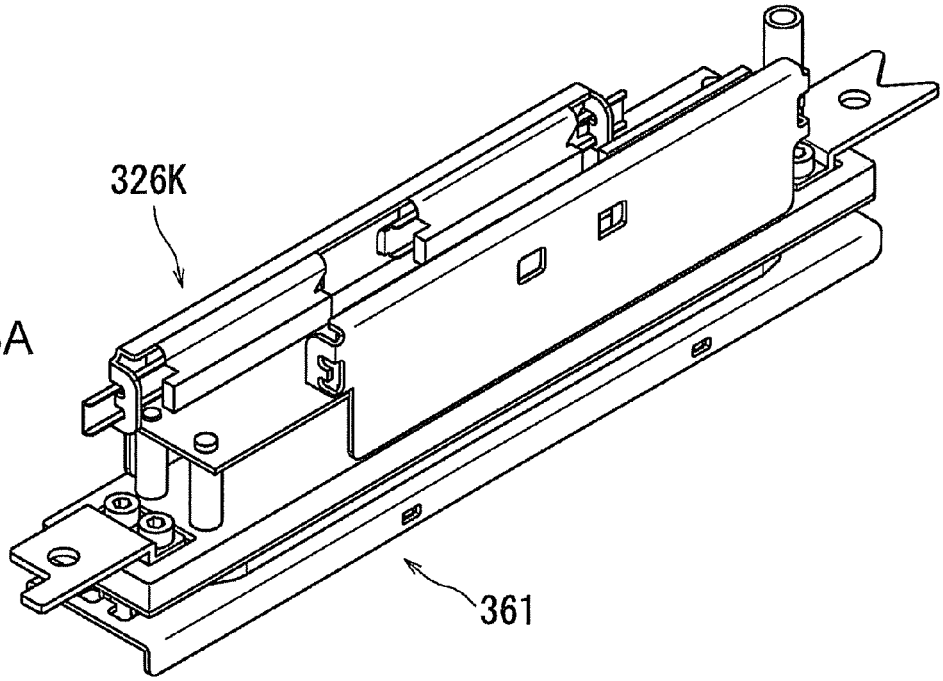
FIG. 3A and FIG. 3B are perspective views illustrating a state where a cap is attached to a nozzle head illustrated in FIG. 1.
Figure 3B:
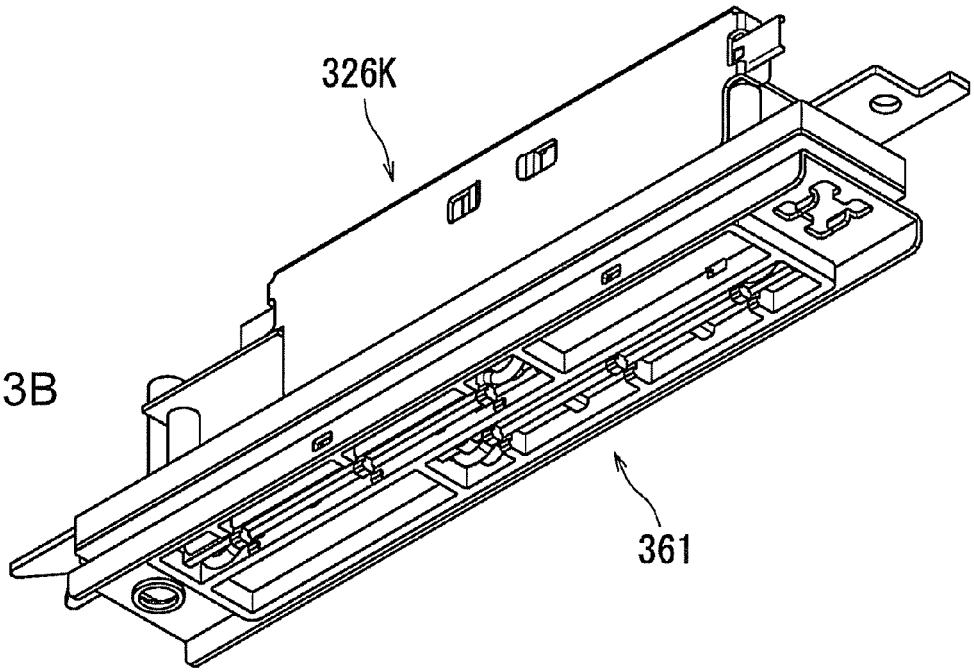
Figure 4A:
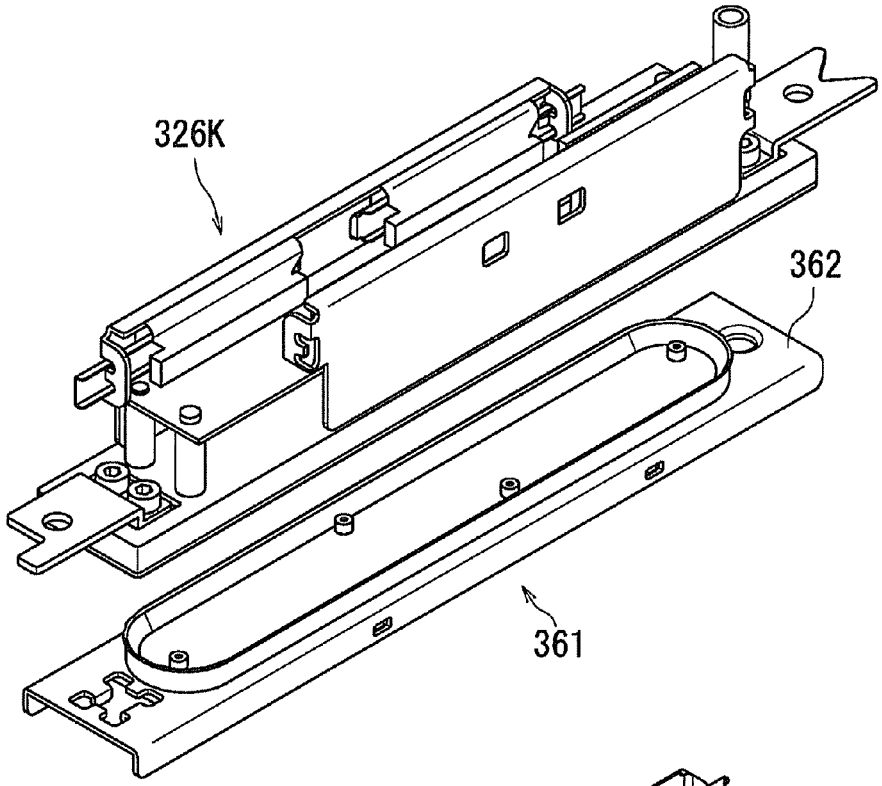
FIG. 4A and FIG. 4B are perspective views illustrating a state where the cap is removed from the nozzle head.
Figure 4B:
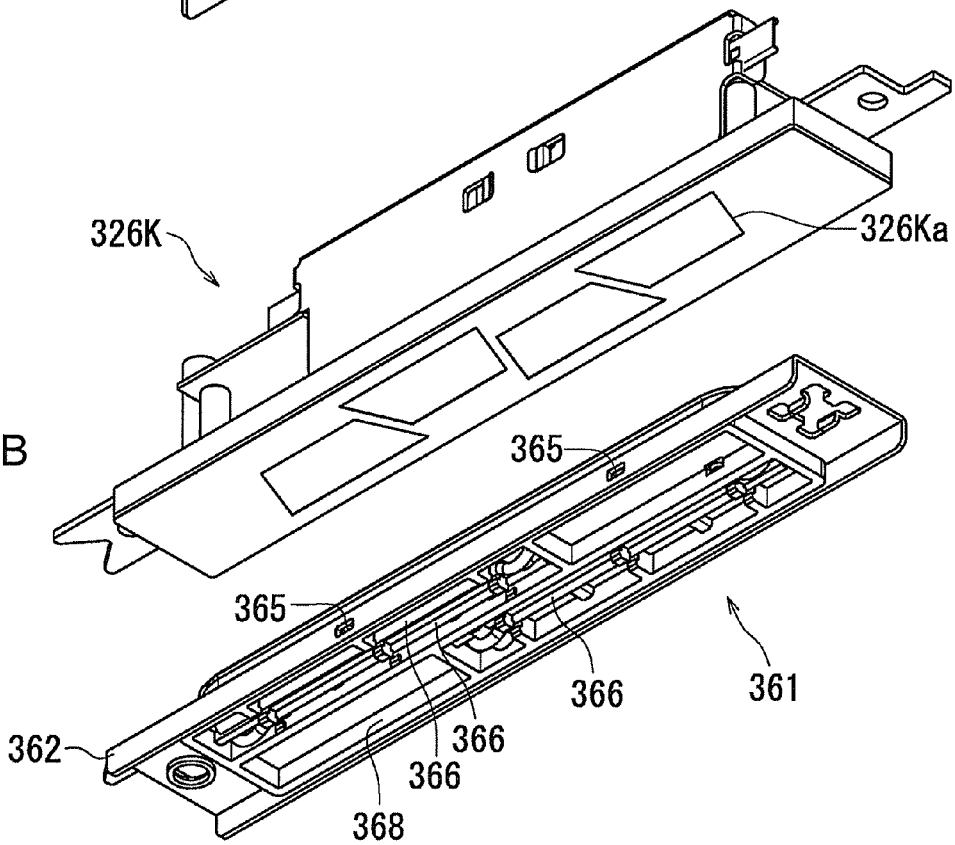
Figure 5A:
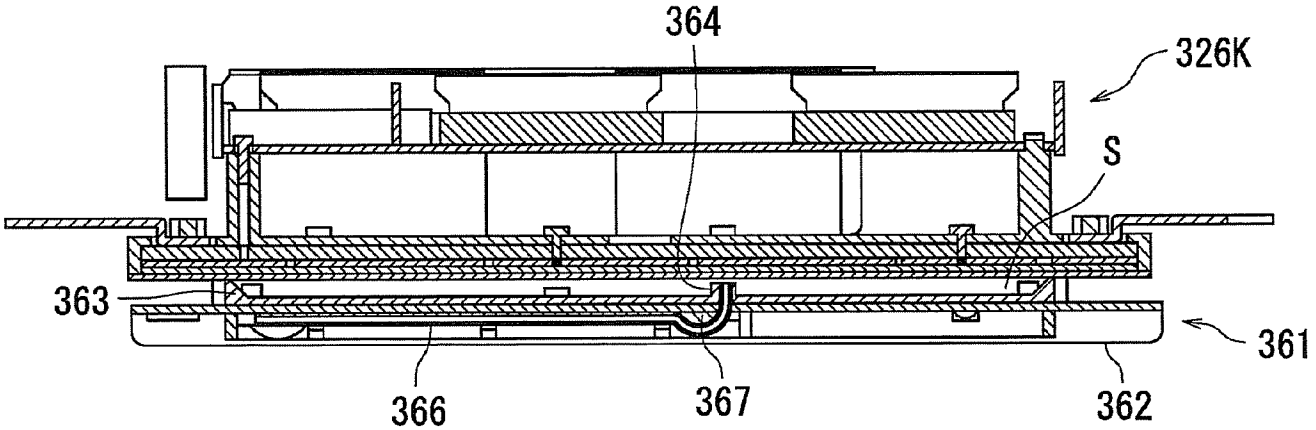
FIG. 5A and FIG. 5B are cross-sectional views of the cap and the nozzle head.
Figure 5B:
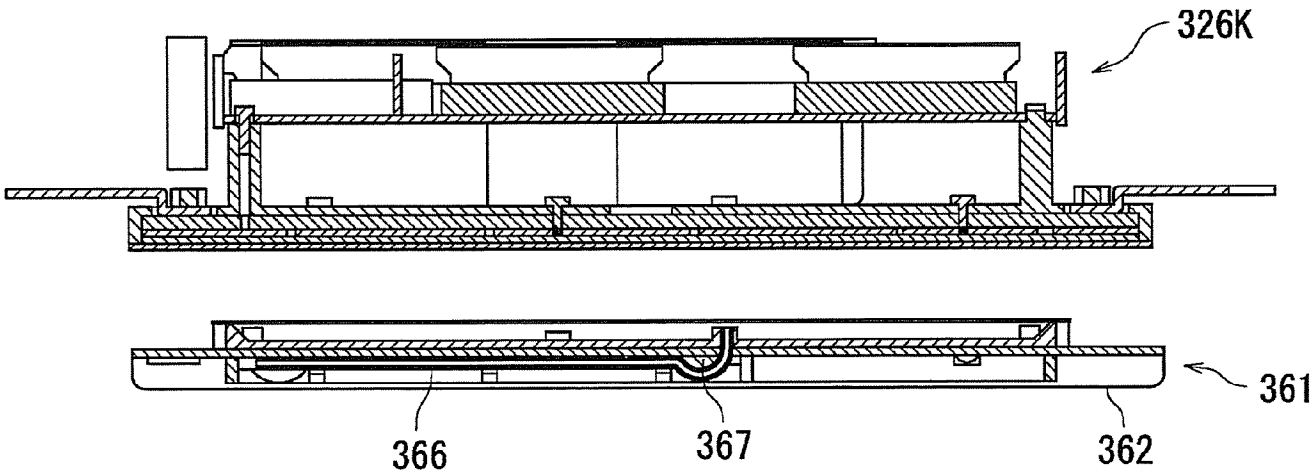

FIG. 3A and FIG. 3B illustrate a state where the cap 361 is attached to the nozzle head 326K illustrated in FIG. 1. FIG. 3A is viewed from upward, and FIG. 3B is viewed from downward. FIG. 4A and FIG. 4B illustrate a state where the cap 361 is removed from the nozzle head 326K. FIG. 4A is viewed from upward, and FIG. 4B is viewed from downward. FIG. 5A and FIG. 5B are cross-sectional views of the cap 361 and the nozzle head 326K. FIG. 5A illustrates a state where the cap 361 is attached to the nozzle head 326K, and FIG. 5B illustrates a state where the cap 361 is removed from the nozzle head 326K.

The cap 361 is attachably/detachably attached to the bottom surface of the nozzle head 326K. In FIG. 4B, four trapezoidal-shaped regions illustrated at the bottom surface of the nozzle head 326K indicate ink discharge openings 326Ka. Structures of the nozzle heads 326C, 326M, and 326Y are basically the same as the structure of the nozzle head 326K. Accordingly, the descriptions on the nozzle heads 326C, 326M, and 326Y will not be further elaborated here.

As illustrated in FIG. 4B, the cap 361 includes a cap main body 362, a tube 366, a guiding member 367 (see FIG. 5A and FIG. 5B), and a tube holder 368. The cap main body 362 includes two engaging holes 365 on both side surfaces. As illustrated in FIG. 5A, the cap main body 362 includes the four ventholes 364 (details will be described later) on the top surface.

Figure 6:
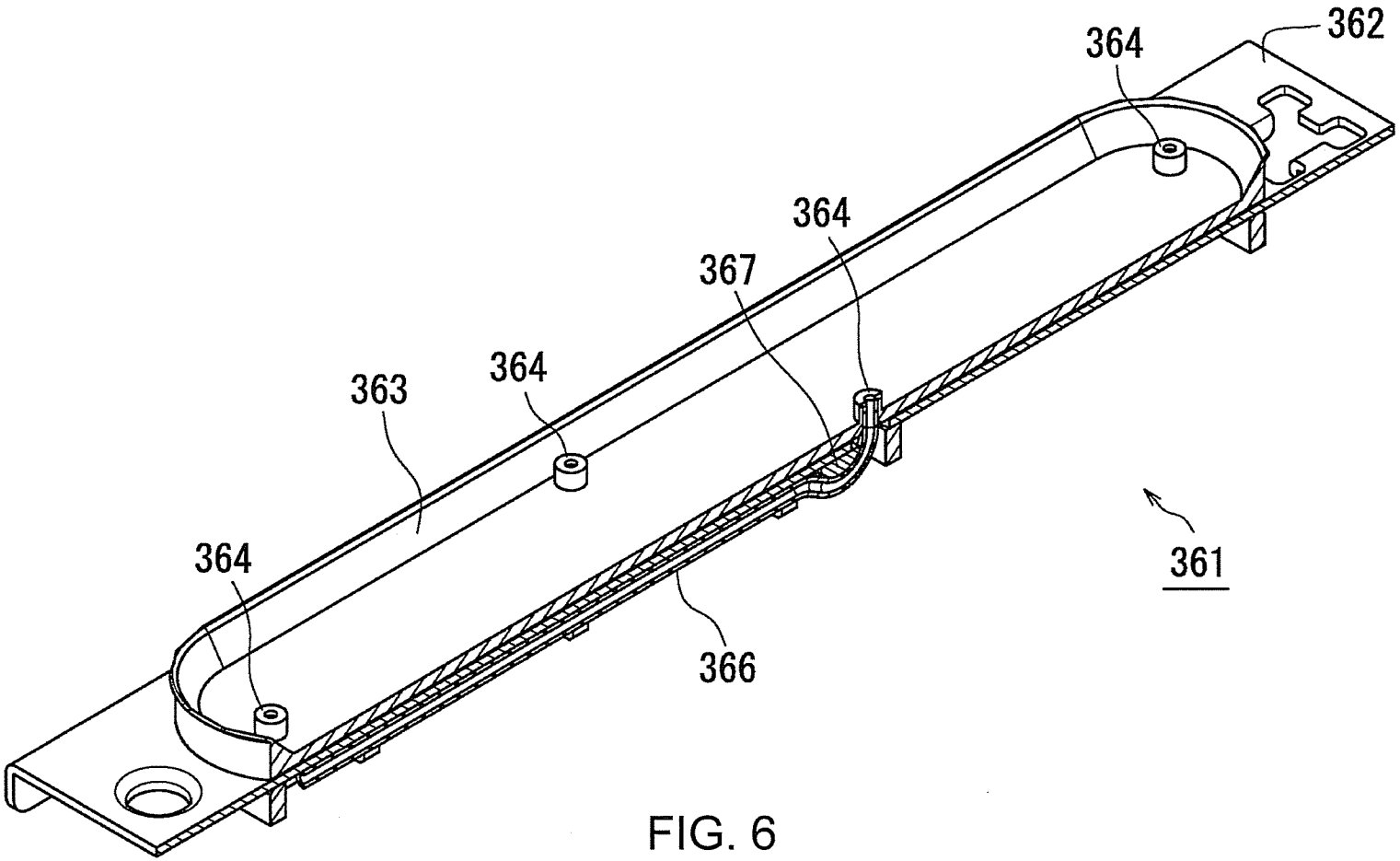
FIG. 6 is a partial cutaway perspective view of the cap.
Figure 7:
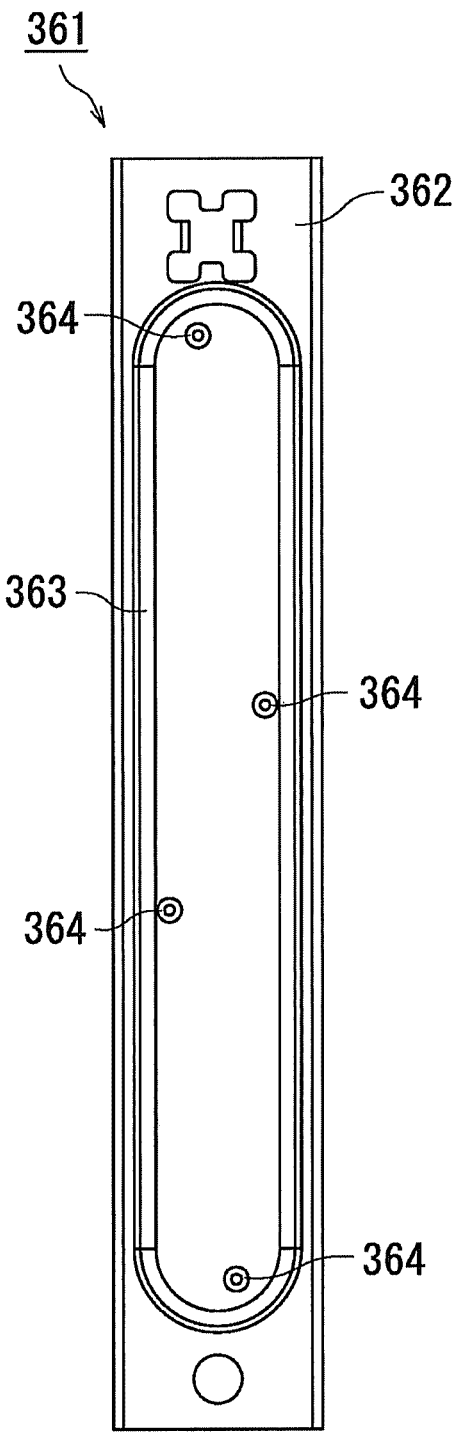
FIG. 7 is a plan view of the cap.
Figure 8:
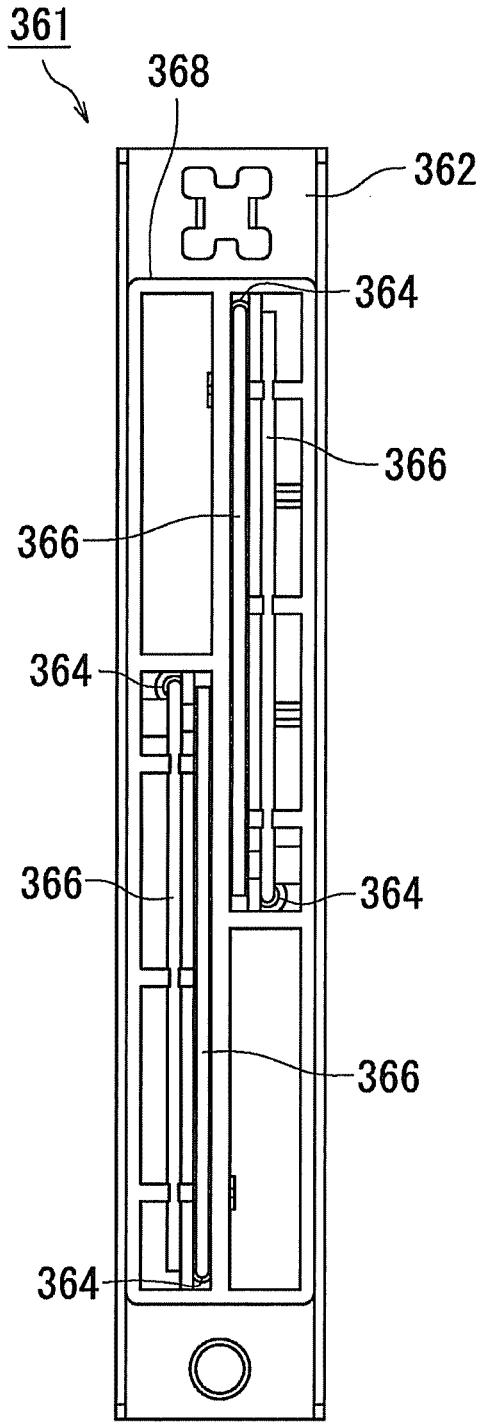
FIG. 8 is a bottom view of the cap.

FIG. 6 is a partial cutaway perspective view of the cap 361. FIG. 7 is a plan view of the cap 361. FIG. 8 is a bottom view of the cap 361.

As illustrated in FIG. 6, the cap main body 362 is an elongated plate-shaped member. The cap main body 362 is formed of synthetic resin excellent in modulus of repulsion elasticity and deterioration resistance, such as Ethylene Propylene Diene Methylene (EPDM) and butyl rubber. The cap main body 362 includes an annular rib 363, the four ventholes 364, and the four engaging holes 365 (see FIG. 4B).

The annular rib 363 projects upward from the top surface of the cap main body 362 and is formed in an ellipse shape in plan view as illustrated in FIG. 7. By attaching the cap 361 to the nozzle head 326K, the upper end portion of the annular rib 363 is brought into pressure contact with the bottom surface of the nozzle head 326K. Each of the four ink discharge openings 326Ka (see FIG. 4B) is positioned inside of the annular rib 363, thus being capped by the cap main body 362. With the ink discharge openings 326Ka capped by the cap main body 362, an internal space S (see FIG. 5A) of the cap main body 362 communicates with the ink discharge openings 326Ka.

As illustrated in FIG. 6, the venthole 364 has a cylindrical shape and projects upward from the top surface of the cap main body 362 at the inner region of the annular rib 363. Each of the four ventholes 364 is integrally formed with the annular rib 363. Each of the four ventholes 364 is formed to be positioned outside of the regions where the four ink discharge openings 326Ka (see FIG. 4B) are projected on the top surface of the cap main body 362. Accordingly, ink dropped from the ink discharge openings 326Ka is unlikely to flow into the ventholes 364. As a result, this reduces the ventholes 364 from being blocked with ink.

The tube 366 is formed of low-density polyethylene, for example. Low-density polyethylene provides good barrier property against water vapor and is easily formed in a tube shape. One end of the tube 366 is coupled to the venthole 364 using press fitting and the other end is open to the atmosphere. The tube 366 causes the internal space S (see FIG. 5A) to communicate with the atmosphere. In this embodiment, the venthole 364 and the tube 366 constitute an atmosphere communication unit according to this disclosure.

It is preferred that the tube 366 and the cap main body 362 be secured with adhesive. In the case where the tube 366 is formed of low-density polyethylene and the cap main body 362 is formed of EPDM, use of cyanoacrylate-based instantaneous adhesive is preferred. Use of the cyanoacrylate-based instantaneous adhesive shortens the bonding period of the tube 366 made of low-density polyethylene and the cap main body 362 made of EPDM, which does not have good adhesive property with such tube 366, thus improving production efficiency.

Figure 9:
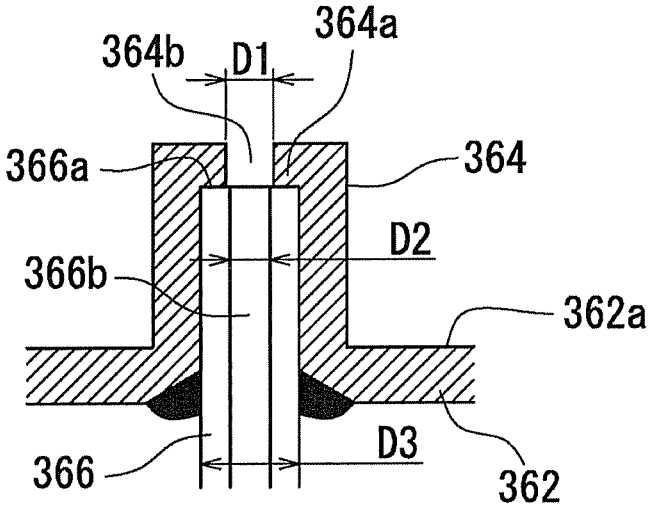
FIG. 9 is a partially enlarged cross-sectional view of a cap main body.

FIG. 9 is a partially enlarged cross-sectional view of the cap main body 362. The venthole 364 includes a stopper 364*a* at an inner periphery at the upper end. The tube 366 includes a tip end face 366*a* at the one end. The tip end face 366*a* contacts the stopper 364*a*, and then the tube 366 is restricted to a press-in direction. This allows reducing contact of the tip end face 366*a* of the tube 366 with a component other than the cap main body 362 and blocking a ventilation passage 366*b* of the tube 366.

The stopper 364*a* is formed in a flange shape projecting toward the inside of the venthole 364 in the radial direction and includes a communication hole 364*b* at the center. With the tip end face 366*a* of the tube 366 contacting the stopper 364*a*, the internal space S (see FIG. 5A) communicates with the inside of the tube 366 via the communication hole 364*b*. Relationship among a diameter D1 of the communication hole 364*b*, an inner diameter D2 of the tube 366, and an inner diameter D3 of the venthole 364 is $D2<D1<D3$ in the example of FIG. 9. The relationship may be $D1<D2<D3$. It is only necessary to design the relationship to be $D1<D3$. The tip end face 366*a* of the tube 366 contacting the stopper 364*a* is located inward of the cap main body 362 with respect to an inner wall surface 362*a* of the cap main body 362.

Figure 10A:
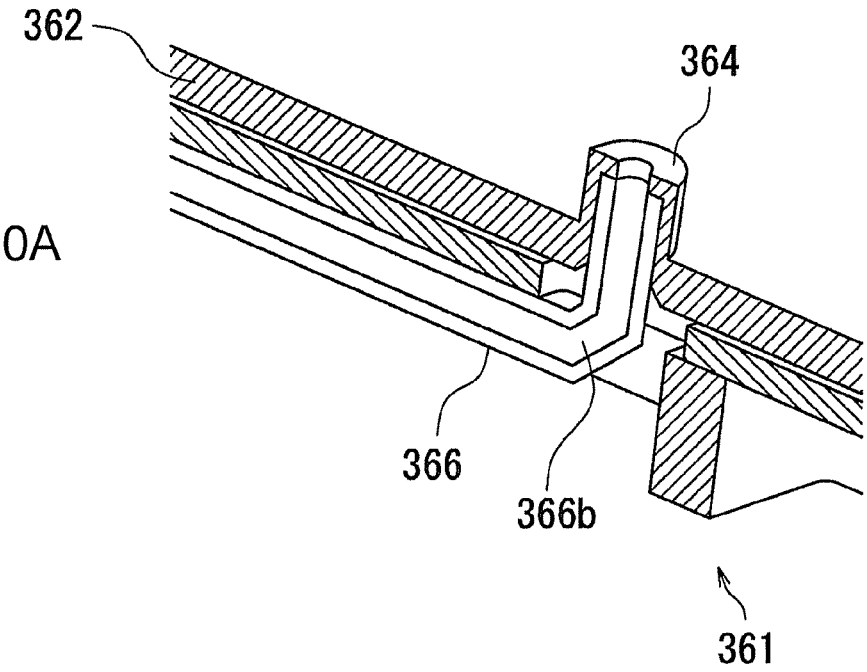
FIG. 10A and FIG. 10B are explanatory views of an action and effect when a tube is bent at one end side.
Figure 10B:
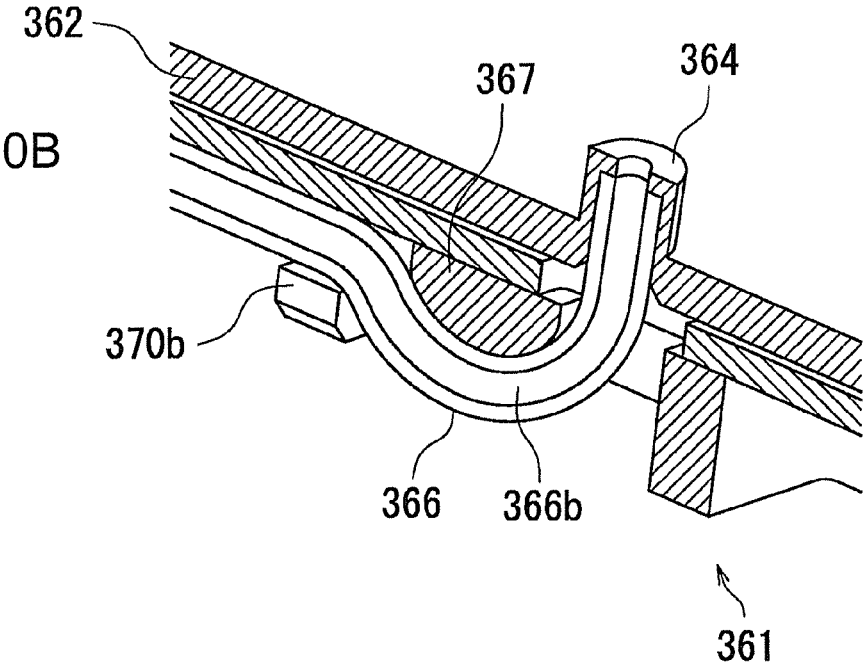

FIG. 10A and FIG. 10B are explanatory views of an action and effect when the tube 366 is bent at one end side. FIG. 10A illustrates a case where the guiding member 367 is not disposed at the cap 361. FIG. 10B illustrates a case where the guiding member 367 is disposed at the cap 361.

As illustrated in FIG. 10A, when one end side of the approximately horizontal tube 366 is bent and the one end of the tube 366 is coupled to the venthole 364, the tube 366 does not hang down in the axial direction of the venthole 364. This allows reducing a space below the cap 361.

As illustrated in FIG. 10B, when the one end side of the approximately horizontal tube 366 is bent in a circular arc shape along a circumference surface of the guiding member 367 with cross-sectional semicolumnar shape, and the one end of the tube 366 is coupled to the venthole 364, a cross-sectional area of the curving part of the ventilation passage 366*b* of the tube 366 becomes approximately equal to a cross-sectional area of a straight line part of the ventilation passage 366*b*. Accordingly, in addition to the effect that the space below the cap 361 can be saved, pressure loss is unlikely to occur in the ventilation passage 366*b*, thus achieving an action and effect of good air circulation in the tube 366. Since a force acting on the one end of the tube 366 in the direction of exiting from the venthole 364 becomes smaller compared with the case illustrated in FIG. 10A, the one end of the tube 366 is unlikely to be detached from the venthole 364. Accordingly, reliability improves.

Figure 11A:
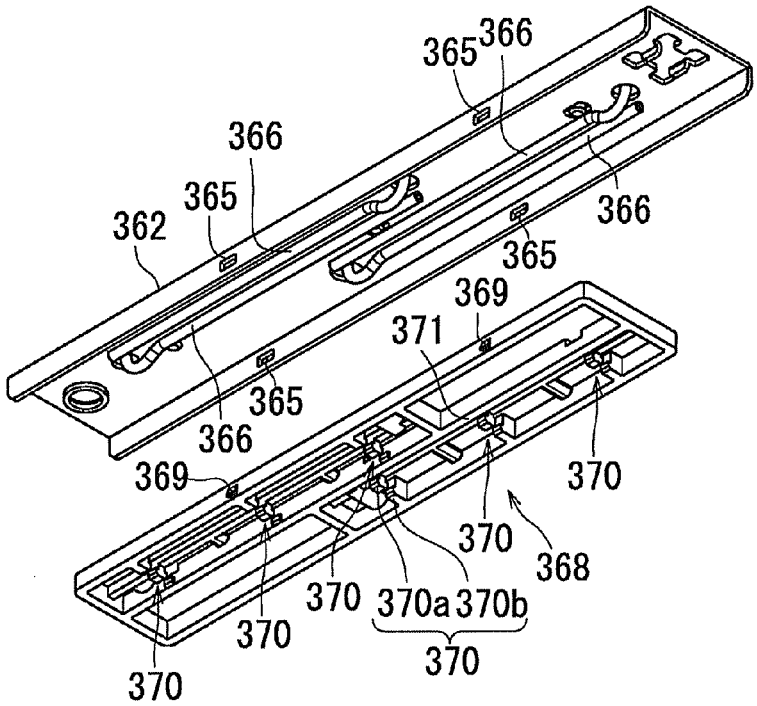
FIG. 11A is a perspective view illustrating a state where a tube holder is removed from the cap main body and a bottom view of the tube holder.
Figure 11B:
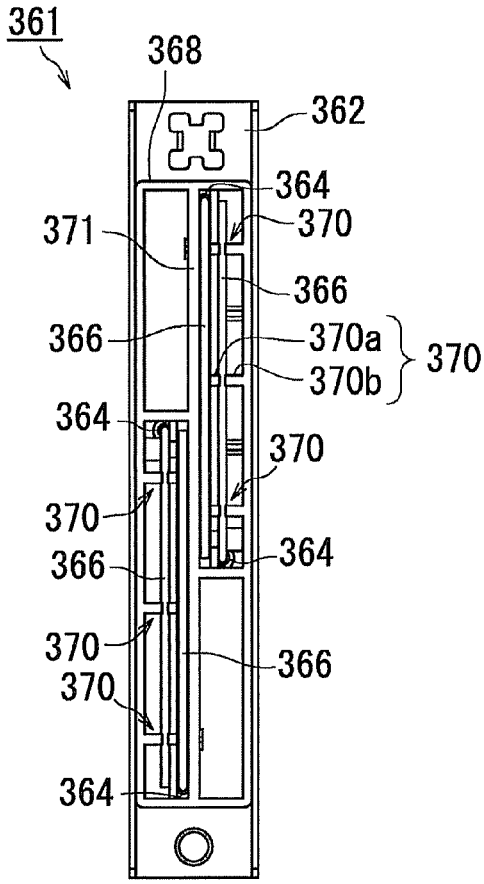
FIG. 11B is a bottom view of the tube holder.

FIG. 11A is a perspective view illustrating a state where the tube holder 368 is removed from the cap main body 362. FIG. 11B is a bottom view of the tube holder 368.

The tube holder 368 is a frame-shaped member and is formed of synthetic resin. The tube holder 368 includes four engaging claws 369 (only two of them are shown) and six tube engaging units 370.

The cap main body 362 includes the two engaging holes 365 at an interval on each of both side surfaces. The engaging claw 369 of the tube holder 368 is freely engaged/disengaged with/from each of the four engaging holes 365. The four engaging claws 369 freely engage/disengage the cap main body 362 by being urged against the cap main body 362 in a direction within a plane approximately parallel to the bottom surface of the nozzle head 326K. This consequently saves the space below the cap 361. The engaging claws 369 are also referred to as a cap engaging portion.

The four engaging claws 369 are disposed on both side surfaces of the tube holder 368 by two by two at an interval. By moving the top surface of the tube holder 368 close to the bottom surface of the cap main body 362, each of the four engaging claws 369 engages the engaging hole 365 of the cap main body 362, thus the tube holder 368 is secured to the cap main body 362. By pressing each of the four engaging claws 369 inward of the cap main body 362, the engaging claw 369 and the engaging hole 365 are disengaged, thus the tube holder 368 is detached from the cap main body 362.

The tube engaging unit 370 includes a pair of protrusions 370*a* and 370*b* facing one another. The tube engaging unit 370 functions as a tube holding unit that engageably/disengageably holds the tube 366. The tube holder 368 includes a rib 371 across the longitudinal direction of the tube holder 368. The rib 371 and the protrusion 370*a* of the tube engaging unit 370 function as a tube holding unit that engageably/disengageably holds the tube 366. The pair of protrusions 370*a* and 370*b* engageably/disengageably hold the tube 366 by being urged against the tube 366 in a direction within the plane approximately parallel to the bottom surface of the nozzle head 326K. This consequently saves the space below the cap 361. The protrusions 370*a* and 370*b* are also referred to as a tube holding portion.

When the tube 366 is pressed into between the protrusions 370*a* and 370*b* from the lower side of the tube holder 368, the tube 366 engages between the protrusions 370*a* and 370*b*, thus the tube 366 is securely held. When the tube 366 is pressed into between the protrusion 370*a* and the rib 371 from the lower side of the tube holder 368, the tube 366 engages between the protrusion 370*a* and the rib 371, thus the tube 366 is securely held. This allows securing the tube 366 to the tube holder 368 in a single operation of good work efficiency, thus enhancing work efficiency.

As illustrated in FIG. 11B, the two tubes 366 among the four tubes 366 are secured with the three tube engaging units 370. The remaining two tubes 366 are interposed between the rib 371 and the protrusions 370*a* of the three tube engaging units 370 and are secured. The four tubes 366 are held approximately parallel to the bottom surface of the nozzle head 326K with the tube holder 368.

The cap 361 and the ink-jet recording apparatus 1 according to this disclosure are described with reference to FIG. 1 to FIG. 11B. According to this disclosure, the one end of the tube 366 is directly coupled to the venthole 364 formed at the cap main body 362 using press fitting; and therefore no another component is interposed between the one end of the tube 366 and the cap main body 362. Accordingly, the cap 361 has a simple structure, achieving low production cost, compared with the complicated structure of the related art that couples the metal pipe to the cap main body through a cap base, for example.

Compared with the case where another component is interposed between the one end of the tube 366 and the cap main body 362, the reduced number of bonding points of components improves air tightness in the internal space S of the cap main body 362.

Since the four ventholes 364 are disposed at the cap main body 362, even if a part of the venthole 364 is blocked with, for example, a foreign object, the internal space S can be kept communicating with the atmosphere via another venthole 364. This achieves high reliability.

Since the tip end face 366*a* of the tube 366 is positioned inward of the cap main body 362 with respect to the inner wall surface 362*a* of the cap main body 362, a foreign object deposited on the inner wall surface 362*a* of the cap main body 362 is unlikely to flow into the tube 366. Accordingly, the tube 366 is unlikely to be blocked with the foreign object, thus providing high reliability.

Embodiments of the disclosure are described above. It will be appreciated that the disclosure will not be limited to the embodiments described above, but various modifications can be made to the embodiments described above.

In the embodiment, the four ventholes are formed at the cap main body; however, equal to or less than three or equal to or more than five ventholes may be formed at the cap main body, for example.

In the embodiment, the cap includes four tubes; however, equal to or less than three or equal to or more than five tubes may be included.

In the embodiment, three tube holding units are disposed for one tube; however, equal to or less than two or equal to or more than four tube holding units may be disposed for one tube.

In the embodiment, the case where this disclosure is applied to the ink-jet recording apparatus with the line type recording head secured to the apparatus casing is described; however, this disclosure is not limited to such ink-jet recording apparatus. This disclosure may be applied to the ink-jet recording apparatus with a recording head moving with respect to the apparatus casing, for example. This disclosure may be applied to the ink-jet recording apparatus with a serial type recording head, for example.

Besides, various modifications can be made to the embodiments described above without departing from the gist of the disclosure.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A cap for capping an ink discharge opening of a nozzle head, comprising:

a cap main body configured to cap the ink discharge opening; and an atmosphere communication unit configured to couple an internal space of the cap main body to atmosphere in a state where the cap main body caps the ink discharge opening, wherein the cap main body is configured to couple the internal space to the ink discharge opening in a state where the ink discharge opening is capped, the atmosphere communication unit includes:

a venthole integrally formed to the cap main body, and a tube coupled to the venthole so as to couple the internal space to atmosphere, and a tube holding unit that engageably/disengageably holds the tube, and the tube includes one end coupled to the venthole using press fitting; and the tube holding unit is formed of synthetic resin and includes a cap engaging portion to couple the tube holding unit to the cap main body, and the cap engaging portion engages the cap main body by being urged against the cap main body in a direction within a plane approximately parallel to a bottom surface of the nozzle head.

2. The cap according to claim 1, wherein a tip end face of the one end of the tube is positioned inward of the cap main body with respect to an inner wall surface of the cap main body.

3. The cap according to claim 1, wherein the tube is bent at one end side, the bent one end being coupled to the venthole.

4. The cap according to claim 3, further comprising a guiding member that bends the one end side of the tube into an arc shape.

5. The cap according to claim 4, wherein the guiding member bends the one end side of the tube into a circular arc shape.

6. The cap according to claim 1, further comprising:

a stopper configured to contact a tip end face of the one end of the tube to restrict the tube in a press-in direction; and the stopper has a communication hole to couple the internal space to an inside of the tube in a state where the tip end face contacts the stopper.

7. The cap according to claim 1, wherein the cap main body has a plurality of the ventholes.

8. The cap according to claim 1, wherein the tube holding unit includes a tube holding portion to engageably/disengageably hold the tube to the tube holding unit, and the tube holding portion engageably/disengageably holds the tube by being urged against the tube in a direction within a plane approximately parallel to the bottom surface of the nozzle head.

9. The cap according to claim 1, wherein the cap main body is formed of synthetic resin, and the tube is formed of low-density polyethylene.

10. The cap according to claim 9, wherein the cap main body is formed of Ethylene Propylene Diene Methylene, and the tube is secured to the cap main body using cyanoacrylate-based instantaneous adhesive.

11. An ink-jet recording apparatus, comprising:

a nozzle head with an ink discharge opening; and a cap according to claim 1.

* * * * *